US009827660B2

(12) United States Patent
Blum et al.

(10) Patent No.: US 9,827,660 B2
(45) Date of Patent: Nov. 28, 2017

(54) HAND TOOL DEVICE

(71) Applicant: Robert Bosch GmbH, Stuttgart (DE)

(72) Inventors: Jens Blum, Filderstadt (DE); Heiko Roehm, Stuttgart (DE); Tobias Herr, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 487 days.

(21) Appl. No.: 13/727,041

(22) Filed: Dec. 26, 2012

(65) Prior Publication Data

US 2013/0161043 A1 Jun. 27, 2013

(30) Foreign Application Priority Data

Dec. 27, 2011 (DE) ..... 10 2011 089 913

(51) Int. Cl.
*E02D 7/02* (2006.01)
*B25D 16/00* (2006.01)
*B25D 11/10* (2006.01)

(52) U.S. Cl.
CPC ..... *B25D 16/006* (2013.01); *B25D 11/104* (2013.01); *B25D 2211/061* (2013.01); *B25D 2216/0023* (2013.01); *B25D 2216/0038* (2013.01); *B25D 2216/0069* (2013.01)

(58) Field of Classification Search
CPC ..... B25D 2216/0023; B25D 16/006; B25D 16/00
USPC ..... 173/47–48
See application file for complete search history.

(56) References Cited

U.S. PATENT DOCUMENTS 4,134,460 A * 1/1979 Klemm ..... 173/218
4,957,171 A * 9/1990 Morrison et al. ..... 173/104
5,025,869 A * 6/1991 Terunuma ..... B25D 11/04 173/104
5,277,527 A 1/1994 Yokota et al.
6,213,695 B1 * 4/2001 Breitenmoser ..... B25F 5/001 173/178
6,223,833 B1 * 5/2001 Thurler ..... B25D 16/00 173/109
6,223,834 B1 5/2001 Takamura et al.
6,325,157 B1 * 12/2001 Arakawa et al. ..... 173/201
6,457,535 B1 * 10/2002 Tanaka ..... B25B 21/00 173/178
6,488,451 B1 12/2002 Hartman
6,796,921 B1 * 9/2004 Buck ..... B25F 5/001 173/47
7,225,884 B2 * 6/2007 Aeberhard ..... 173/93.5
7,237,625 B2 * 7/2007 Minshull et al. ..... 175/135
7,308,948 B2 * 12/2007 Furuta ..... 173/48
(Continued)

FOREIGN PATENT DOCUMENTS

CN 1236338 A 11/1999
CN 201419268 Y 3/2010
EP 1 690 642 8/2006

*Primary Examiner* — Robert Long
(74) *Attorney, Agent, or Firm* — Norton Rose Fulbright US LLP; Gerard Messina

(57) ABSTRACT

A hand tool device includes: a striking mechanism which has a striker, a striker driving device, and a striker arresting device. In the case of a first drill rotation direction, the striker driving device is configured to propel the striker in at least a striking direction. The striker arresting device is configured to prevent the striker driving device from being operated in the case of a second drill rotation direction.

14 Claims, 11 Drawing Sheets

(56) References Cited

U.S. PATENT DOCUMENTS 7,331,496 B2 * 2/2008 Britz et al. ..... 227/48
9,314,908 B2 * 4/2016 Tanimoto ..... B25B 21/02
2002/0056558 A1 * 5/2002 Bongers-Ambrosius B25D 11/12 173/201
2002/0134172 A1 * 9/2002 Yamada ..... B25B 21/02 73/862.21
2003/0006053 A1 * 1/2003 Campbell, Jr. ..... B25D 9/125 173/206
2003/0173097 A1 * 9/2003 Holzer ..... B25D 16/003 173/178
2004/0188117 A1 * 9/2004 Lebisch ..... B25D 16/006 173/48
2004/0231952 A1 * 11/2004 Nakamura ..... B25F 5/001 192/223
2005/0031424 A1 * 2/2005 Hernandez, Jr. ..... B23B 31/201 408/238
2005/0205274 A1 * 9/2005 Bogue ..... B25B 21/00 173/2
2006/0201688 A1 * 9/2006 Jenner et al. ..... 173/48
2006/0237205 A1 * 10/2006 Sia et al. ..... 173/48
2006/0244224 A1 * 11/2006 Zhou ..... B23B 31/001 279/62
2007/0056756 A1 * 3/2007 Chung et al. ..... 173/48
2009/0058019 A1 * 3/2009 Mack ..... 279/114
2009/0194305 A1 * 8/2009 Xu ..... B25B 21/00 173/48
2009/0200758 A1 * 8/2009 Lam ..... B23B 31/123 279/62
2010/0175902 A1 * 7/2010 Rejman ..... B25D 16/006 173/1
2010/0200257 A1 * 8/2010 Scrimshaw et al. ..... 173/47
2010/0276168 A1 * 11/2010 Murthy ..... B25B 21/023 173/93.5
2011/0127059 A1 * 6/2011 Limberg et al. ..... 173/216
2011/0180288 A1 * 7/2011 Chu ..... B25B 23/141 173/47
2011/0232930 A1 * 9/2011 Zhang et al. ..... 173/178
2011/0303430 A1 * 12/2011 Hartmann ..... B25D 17/06 173/112
2012/0132451 A1 * 5/2012 Hecht ..... B25D 11/062 173/48
2012/0234566 A1 * 9/2012 Mashiko ..... B25B 21/02 173/93.5
2013/0062088 A1 * 3/2013 Mashiko ..... B25B 21/026 173/2
2013/0087355 A1 * 4/2013 Oomori et al. ..... 173/47
2013/0161042 A1 * 6/2013 Blum et al. ..... 173/48
2013/0299206 A1 * 11/2013 Hecht ..... B25B 21/023 173/104
2013/0319709 A1 * 12/2013 Hecht ..... B25D 11/062 173/109
2013/0333910 A1 * 12/2013 Tanimoto ..... B25B 21/02 173/176
2014/0182870 A1 * 7/2014 Herr ..... 173/94

* cited by examiner

E-E

F-F

G-G

H-H

HAND TOOL DEVICE

BACKGROUND OF THE INVENTION

1. Field of the Invention

The present invention relates to a hand tool device including a striking mechanism, which has a striker and a striker driving device, and in the case of a first drill rotation direction, the striker driving device is configured to propel the striker in at least the striking direction.

2. Description of Related Art

Published European patent application document EP 1 690 642 A1 describes a hand tool device including a striking mechanism, which has a striker and a striker driving device; in the case of a first drill rotation direction, the striker driving device being configured to propel the striker in at least the striking direction.

BRIEF SUMMARY OF THE INVENTION

The present invention provides a hand tool device including a striking mechanism, which has a striker and a striker driving device; in the case of a first drill rotation direction, the striker driving device being configured to propel the striker in at least the striking direction.

It is provided that the striking mechanism has a striker arresting device, which is provided to prevent, in particular, automatically, the striker driving device from being operated in the case of a second drill rotation direction. A "striking mechanism" is to be understood, in particular, as a device that is designed to generate a percussive pulse, and in particular, in the direction of an insertion tool. In at least a percussion drill mode, the striking mechanism preferably transmits the striking motion through a tool spindle and/or, in particular, through a tool chuck of the hand tool device, to the insertion tool, in an advantageous manner. In particular, the term "striker" is to be understood as an instrument, which is accelerated, in particular, translationally, in at least a percussion drill mode, and emits a pulse received during the acceleration as a percussive pulse in the direction of the insertion tool. A "striker driving device" is to be understood, in particular, as a unit that is designed to translate a rotational motion into a, in particular, translational striking motion.

The striker driving device preferably has an eccentric drive, a wobble bearing and/or, particularly preferably, a cam guide. In particular, "operation of the striker driving device" is to be understood as an operation, in which an energy, which, in particular, a drive unit of the handheld machine tool device supplies, is mechanically transmitted to the striker driving device. In particular, a "drill rotation direction" is to be understood as a direction of rotation, in which, in at least one working cycle, the tool chuck is rotationally propelled relative to a hand tool housing. The hand tool device is preferably designed to propel the insertion tool in a counterclockwise drill rotation direction and in a clockwise drill rotation direction in at least a drilling mode and/or, advantageously, in at least a screwing mode. A "striking direction" is to be understood as a direction, which runs parallel to an axis of rotation of the tool chuck, and which points from the striker in the direction of the tool chuck. In particular, a "striker arresting device" is to be understood as a device, which, in at least one operating state, prevents at least the operation of the striker driving device. In a mode in which the tool chuck is propelled in the second drill rotation direction, the striker arresting device preferably prevents the striker driving device from being operated.

Alternatively, or in addition, the striker arresting device could prevent a switchover into the percussion drill mode if the second drill rotation direction is set, and/or prevent a switchover to the second drill rotation direction if the percussion drill mode is set. "Designed" is to be understood, in particular, as specially programmed, configured and/or equipped. In particular, the term "automatically" is to be understood to mean that in the second drill rotation direction, the striker arresting device prevents and/or, in particular, interrupts the operation of the striker driving device independently of at least an action of an operator. In this connection, the term "prevent" is to be understood to mean, in particular, that the striker arresting device prevents simultaneous operation of the striker arresting device and operation in the second drill rotation direction. The embodiment of the hand tool device according to the present invention allows a particularly small, light, and yet powerful striking mechanism to be provided, and allows damage to the striking mechanism due to improper operation to be prevented.

In a further embodiment, it is provided that the hand tool device have, in particular, a first planetary gear stage, which actuates the striker driving device in at least one operating state, which means that a compact design may be achieved in a structurally simple manner. A "planetary gear stage" is to be understood, in particular, as a gear stage including at least one planet gear, which is connected to a planet carrier, coupled to a ring gear in a radially outward direction, and coupled to a sun gear in a radially inward direction.

In addition, it is provided that the striker arresting device acts upon a ring gear of the planetary gear stage, through which particularly simple assembly and a low overall length in the striking direction are possible. A "ring gear" is to be understood, in particular, as an annular gear wheel having internal teeth.

In addition, it is provided that the striker arresting device acts upon a planet carrier of the planetary gear stage, which means that a particularly narrow design may be achieved. A "planet carrier" is to be understood, in particular, as a component of a planetary gear stage, which rotatably guides a planet gear on a circular path.

In addition, it is provided that the striker arresting device act upon a striking mechanism spindle of the striking mechanism, through which a particularly narrow design may be attained. A "striking mechanism spindle" is to be understood, in particular, as a shaft, which transmits a rotational motion of the planetary gear stage to the striker driving device. The striking mechanism spindle preferably takes the form of a hollow shaft.

Furthermore, it is provided that the striker arresting device be designed to automatically prevent actuation of the striker driving device in the case of a counterclockwise drill rotation direction, which means that in a percussion drill mode in the clockwise drill rotation direction, work may advantageously be performed, using an insertion tool that takes the form of a standardized percussion drill. In particular, a "counterclockwise drill rotation direction" is to be understood as a rotational direction of the tool chuck, in which, when viewed in the striking direction, the tool chuck rotates in a direction opposite to clockwise. A "clockwise drill rotation direction" is to be understood, in particular, as a rotational direction of the tool chuck, in which, when viewed in the striking direction, the tool chuck rotates clockwise.

In one advantageous embodiment of the present invention, it is provided that the striker arresting device be designed to arrest the striker driving device, in particular, automatically, in the case of a second drill rotation direction, which means that the operator may switch over from a clockwise drill rotation direction to a counterclockwise drill rotation direction in a user-friendly manner, without having to switch off a percussion drill mode. In particular, the term "arrest" is to be understood to mean that when the tool chuck is driven in the second drill rotation direction, the striker arresting device interrupts the operation of the striker driving device, in particular, automatically.

In one further embodiment, it is provided that the striker arresting device has a blocking device, which allows free-running in at least one operating state, through which, in the case of a counterclockwise drill rotation direction, advantageous stoppage may be achieved in a structurally simple manner. A "blocking device" is to be understood, in particular, as a device considered suitable by one skilled in the art, but preferably at least a jamming roller, a clutch mechanism, a detent, a toothed disk and/or a wrap spring. In particular, the term "free-running" is to be understood to mean that in the case of one direction of rotation of a component, in particular, of the ring gear, the blocking device allows the component to rotate with respect to other components, such as the hand tool housing; and that in the case of another direction of rotation of the component, the blocking device prevents the component from rotating with respect to the other component.

Furthermore, it is provided that the striker driving device has a cam guide, which drives the striker in at least a percussion drill mode, whereby a particularly small, light, and yet, powerful striking mechanism is provided. In particular, the need for a wobble bearing or a rocker arm may be advantageously eliminated. In particular, a "cam guide" is to be understood as a device, which, in order to generate a stroke, translates a rotational energy into a linear kinetic energy of the striker, using at least a specially shaped guide surface, along which a connecting device runs during a percussion drill mode. The striking mechanism preferably includes a striking mechanism spring, which stores the linear kinetic energy of the striker in order to generate a stroke. The specially shaped surface is preferably a surface, which limits a guide curve of the cam guide. In this connection, "to drive" is to be understood to mean, in particular, that the cam guide transmits an energy for generating a stroke, to the striker.

In addition, it is provided that the cam guide has a striker free-running region, through which a high stroke energy and an advantageously low degree of wear may be achieved in the case of a low overall length. A "striker free-running region" is to be understood, in particular, as a region of the guide curve of the cam guide, in which the connecting device is situated when the striking mechanism spring accelerates the striker in the striking direction. The striker free-running region is preferably formed to be so wide, that the connecting device may run through the striker free-running region on different paths. In at least the percussion drill mode, the striker free-running region preferably does not exert a force on the striker.

Furthermore, the present invention is directed to a hand tool having a hand tool device according to the present invention. The hand tool is preferably designed to propel the insertion tool in a screwing mode, in a drilling mode, in a screwing/drilling mode and, in particular, in a chipping mode.

DETAILED DESCRIPTION OF THE INVENTION

Figure 1:
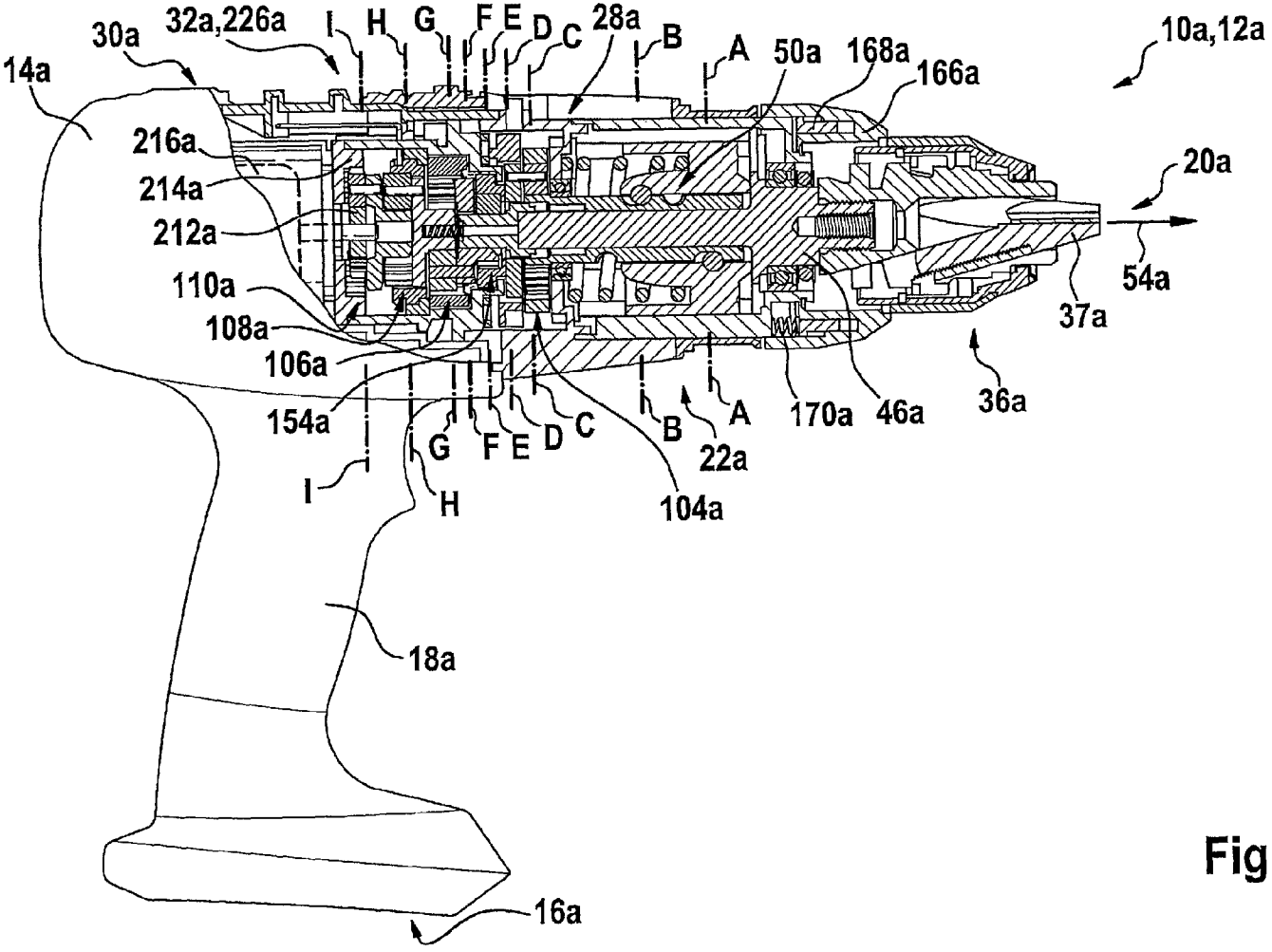
FIG. 1 shows a section of a hand tool including a hand tool device according to the present invention.

FIG. 1 shows a hand tool 10*a*. Hand tool 10*a* takes the form of an impact screwdriver. Hand tool 10*a* includes a hand tool device 12*a* of the present invention, a hand tool housing 14*a* and a storage battery interface 16*a*. Storage battery interface 16*a* is provided for supplying hand tool device 12*a* with electrical energy from a hand-tool storage battery not shown here in further detail. Hand tool housing 14*a* is formed in the shape of a pistol. Hand tool housing 14*a* has multiple parts. It includes a handle 18*a*, by which an operator holds hand tool 10*a* during operation. Hand tool device 12*a* includes a tool support unit 20*a*, a striking mechanism 22*a*, a first striker arresting device 24*a*, a second striker arresting device 26*a*, planetary gearing 28*a*, a drive unit 30*a*, an operating device 32*a* and a torque limiting unit 34*a*.

Tool support unit 20*a* includes a tool chuck 36*a* and a tool spindle 38*a*. During operation, tool chuck 36*a* secures an insertion tool not shown here, such as a drill bit or a screw bit. Tool chuck 36 secures the insertion tool in a friction-locked manner. Tool chuck 36*a* has three chuck jaws, which are movably tightened by an operator and secure the insertion tool during operation. In addition, during operation, tool chuck 36*a* fixes the insertion tool in position in an axially immovable manner with respect to tool chuck 36*a* and, in particular, with respect to tool spindle 38*a*. A portion of tool chuck 36*a* and tool spindle 38*a* are interconnected so as to be stationary relative to one another. Here, tool chuck 36*a* and tool spindle 38*a* are screwed to one another. Hand tool device 12*a* has a bearing device 40*a*, which supports tool spindle 38*a* on a side facing tool chuck 36*a*. Bearing device 40*a* supports tool spindle 38*a* in an axially movable manner. Bearing device 40*a* is connected to tool spindle 38*a* in an axially fixed manner. Bearing device 40*a* is supported in hand tool housing 14*a* in an axially movable manner. Hand tool device 12*a* has a further bearing device 41*a*, which supports tool spindle 38*a* on a side facing planetary gearing 28*a*. In this instance, bearing device 41*a* takes the form of a rolling-contact bearing, in this case, a needle bearing, through which low-clearance support is possible. Bearing device 41*a* supports tool spindle 38*a* in an axially displaceable manner. A striking mechanism spindle 46*a* surrounds bearing device 41*a*. Bearing device 41*a* is functionally situated between tool spindle 38*a* and striking mechanism spindle 46*a*.

Tool spindle 38*a* includes an impact surface 42*a*, which a striker 44*a* of striking mechanism 22*a* strikes during a percussion drill mode. Striker 44*a* has a mass, which is, at a maximum, two thirds as large as a mass of tool support unit 20*a*. In this case, the mass of striker 44*a* is less than half as large as the mass of tool support unit 20*a*. The mass of striker 44*a* is approximately 45% of the mass of tool support unit 20*a*.

Figure 2:
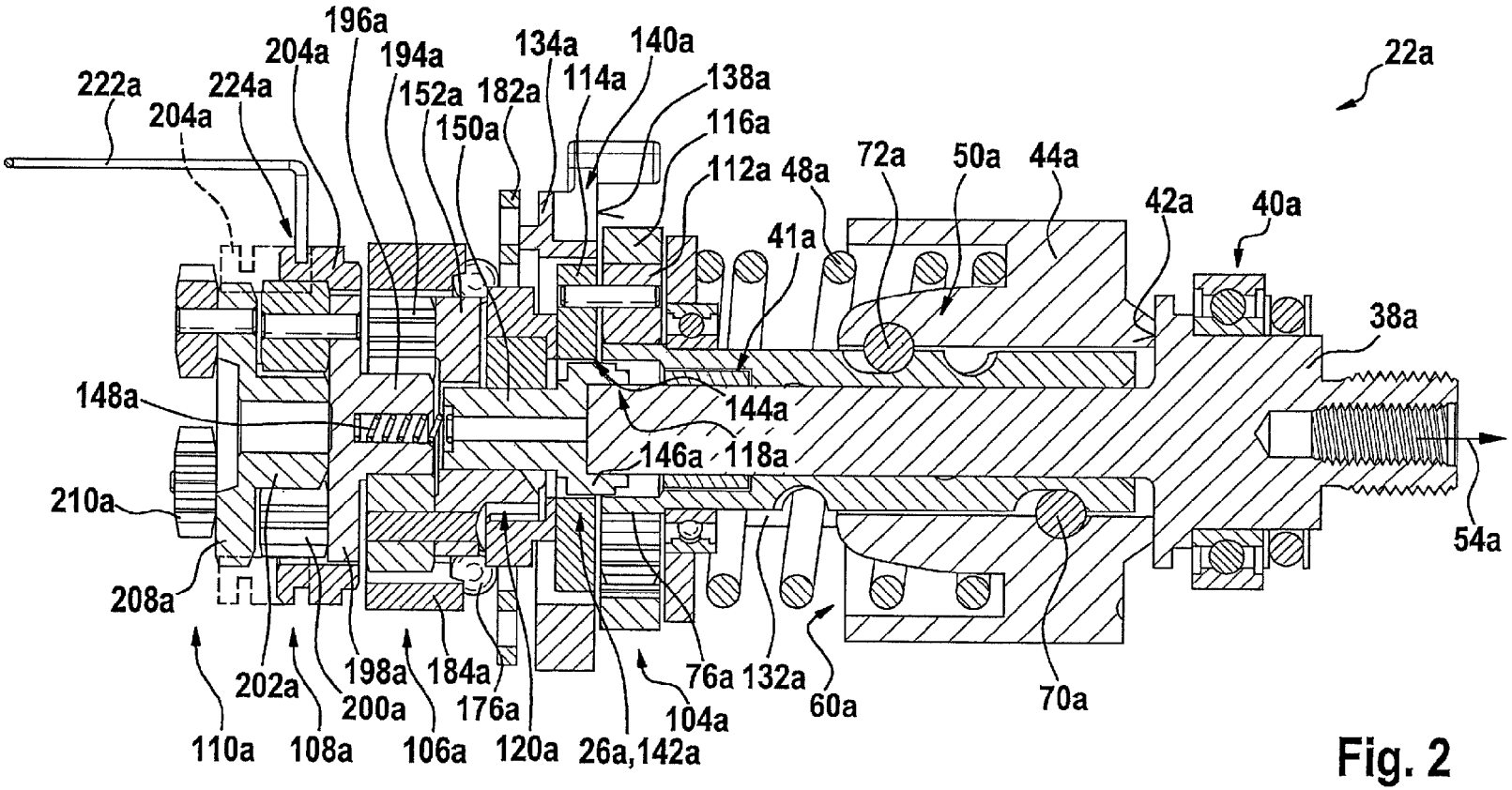
FIG. 2 shows a partially exposed section of a striking mechanism and planetary gearing of the hand tool device from FIG. 1.

In FIG. 2, striking mechanism 22*a* and planetary gearing 28*a* are illustrated in more detail. Striking mechanism 22*a* includes striker 44*a*, striking mechanism spindle 46*a*, a striking mechanism spring 48*a*, a striker driving device 50*a* and a striker guide 52*a*. Striker 44*a* is supported so as to be translationally movable in striking direction 54*a*. Striking direction 54*a* is oriented parallel to an axial direction of striking mechanism spindle 46*a*.

Figure 3:
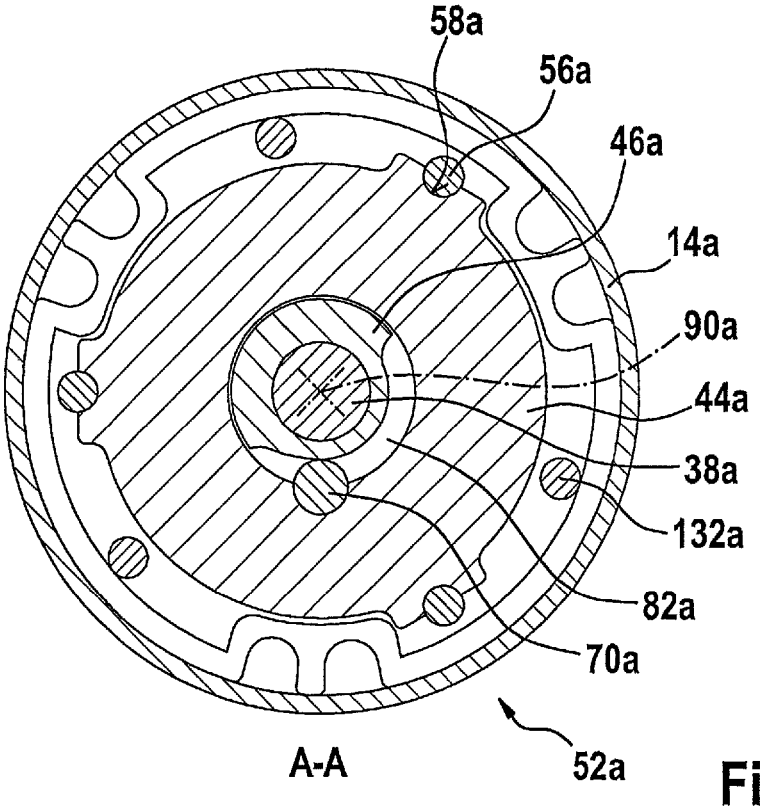
FIG. 3 shows a first sectional plane A of the striking mechanism of the hand tool device from FIG. 1.
Figure 4:
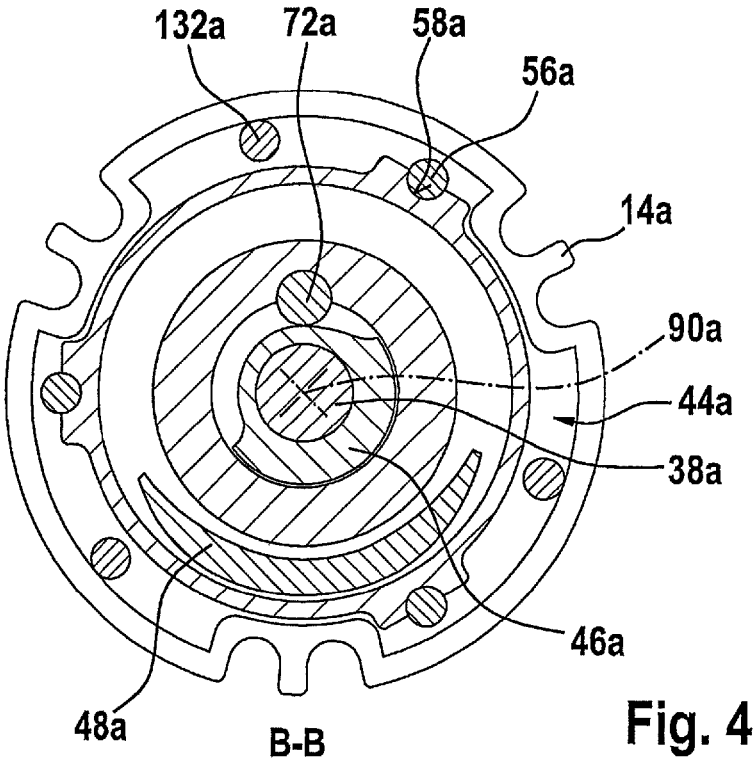
FIG. 4 shows a second sectional plane B of the striking mechanism of the hand tool device from FIG. 1.

FIGS. 3 and 4 show a sectional plane A and a sectional plane B of striking mechanism 22*a*. Striker guide 52*a* supports striker 44*a* so as to be rotatably fixed relative to hand tool housing 14*a*. Striker guide 52*a* has three guide rods 56*a*, on which striker 44*a* slides. Guide rods 56*a* are positioned so as to be evenly spaced about striker 44*a*. Striker 44*a* has sliding surfaces 58*a*, which encircle 180 degrees of the guide rods 56*a* on a plane perpendicular to striking direction 54*a*. On a plane that is oriented perpendicularly to striking direction 54*a*, striker 44*a* encircles 360 degrees of the striking mechanism spindle 46*a*. In addition, striker 44*a* encircles 360 degrees of tool spindle 38*a* on the plane. Furthermore, striking mechanism spindle 46*a* encircles 360 degrees of tool spindle 38*a* on the plane. Striking mechanism spindle 46*a* and tool spindle 38*a* are positioned coaxially.

Figure 5:
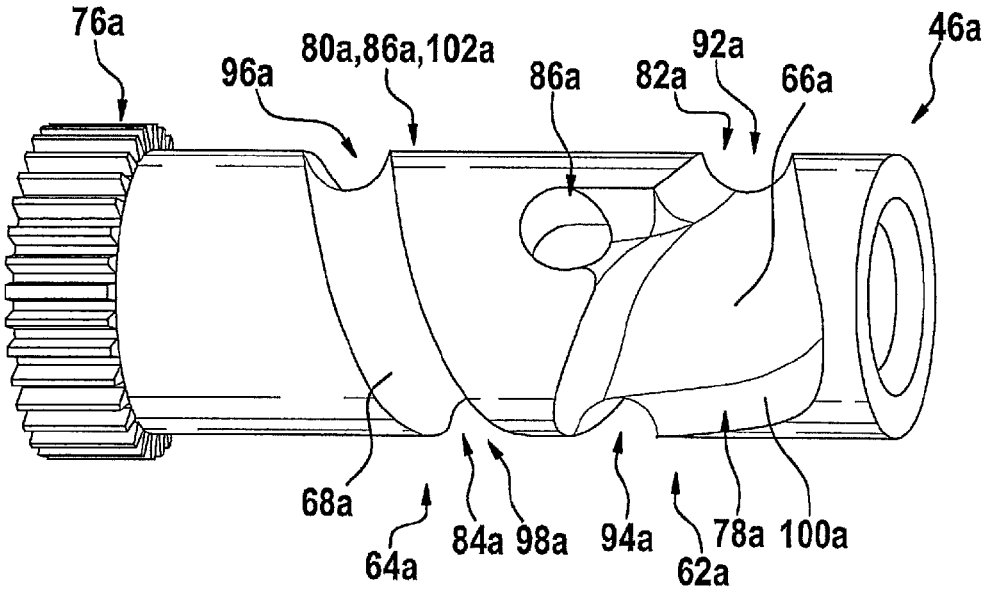
FIG. 5 shows a perspective view of a striking mechanism spindle of the striking mechanism of the hand tool device from FIG. 1.
Figure 6:
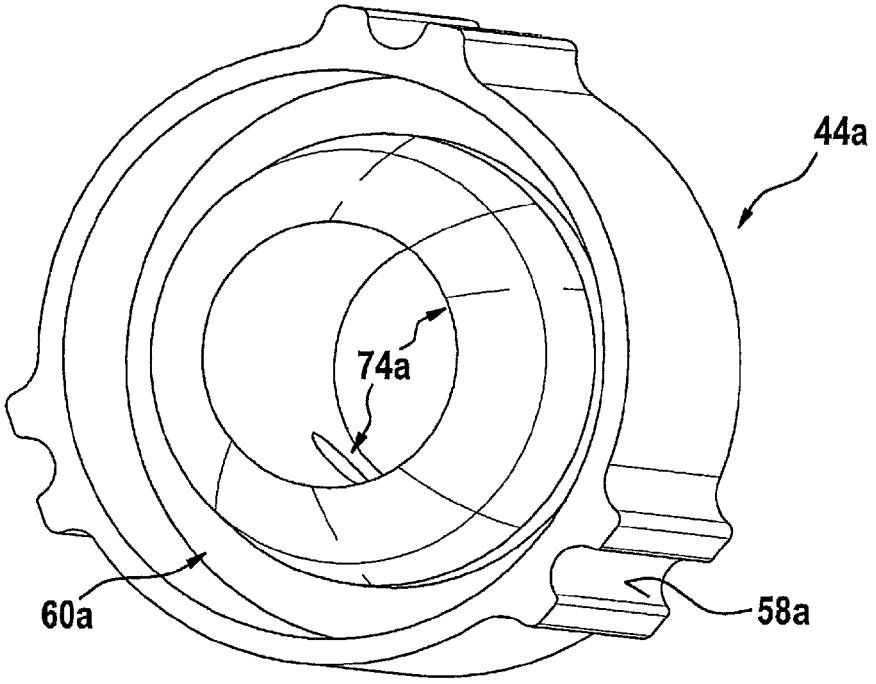
FIG. 6 shows a perspective view of a striker of the striking mechanism of the hand tool device from FIG. 1.

Striking mechanism spring 48*a* accelerates striker 44*a* in striking direction 54*a* prior to an impact. To that end, hand tool housing 14*a* supports striking mechanism spring 48*a* on a side facing away from striker 44*a*. Striking mechanism spring 48*a* presses directly against striker 44*a*. Striker 44*a* has a spring attachment 60*a*. Spring attachment 60*a* takes the form of an annular depression. FIG. 5 shows a perspective view of striking mechanism spindle 46*a*. FIG. 6 shows a perspective view of striker 44*a*. Striker driving device 50*a* has a first cam guide 62*a* and a second first cam guide 64*a*. Cam guides 62*a*, 64*a* include guide curves 66*a*, 68*a* and connecting devices 70*a*, 72*a*, respectively. Connecting devices 70*a*, 72*a* are spherical. Striker 44*a* supports connecting devices 70*a*, 72*a* in a fixed manner relative to striker 44*a*. Striker 44*a* includes hemispherical attachment recesses 74*a*. In a percussion drill mode, connecting devices 70*a*, 72*a* slide in guide curves 66*a*, 68*a*. Striking mechanism spindle 46*a* has a part of cam guides 62*a*, 64*a*, namely, guide curves 66*a*, 68*a*. Striking mechanism spindle 46*a* delimits a space, in which connecting devices 70*a*, 72*a* move during a percussion drill mode.

Striking mechanism spindle 46*a* takes the form of a hollow shaft. Planetary gearing 28*a* drives striking mechanism spindle 46*a*. To that end, striking mechanism spindle 46*a* has gear teeth 76*a* on a side facing away from tool chuck 36*a*. Guide curves 66*a*, 68*a* each have a striker free-running region 78*a*, 80*a*, a striker lifting region 82*a*, 84*a*, and an assembly opening 86*a*, 88*a*. During assembly, connecting devices 70*a*, 72*a* are inserted through assembly openings 86*a*, 88*a* into attachment recesses 74*a* of striker 44*a*. Viewed in striking direction 54*a*, striking mechanism spindle 46*a* rotates clockwise during percussion drill mode. Striker lifting regions 82*a*, 84*a* are helically shaped. They extend 180 degrees around an axis of rotation 90*a* of striking mechanism spindle 46*a*. In percussion drill mode, striker lifting regions 82*a*, 84*a* move connecting devices 70*a*, 72*a* and, therefore, striker 44*a* opposite to striking direction 54*a*. Thus, striking mechanism 22*a* includes connecting devices 70*a*, 72*a*, which transmit a motion of striking mechanism spindle 46*a* to striker 44*a* in at least one operating state.

Striker free-running regions 78*a*, 80*a* each connect two ends 92*a*, 94*a*, 96*a*, 98*a* of striker lifting regions 82*a*, 84*a*. Striker free-running regions 78*a*, 80*a* extend 180 degrees around an axis of rotation 90*a* of striking mechanism spindle 46*a*. Striker free-running regions 78*a*, 80*a* each have a striking edge 100*a*, 102*a*, which, starting from an end 94*a*, 96*a* of striker lifting region 82*a* facing planetary gearing 28*a*, runs approximately parallel to striking direction 54*a*. After connecting devices 70*a*, 72*a* penetrate into striker free-running regions 78*a*, 80*a*, striking mechanism spring 48*a* accelerates striker 44*a* and connecting devices 70*a*, 72*a* in striking direction 54*a*. In this context, connecting devices 70*a*, 72*a* move through striker free-running regions 78*a*, 80*a* without experiencing an axial force, until striker 44*a* strikes impact surface 42*a*. Cam guides 62*a*, 64*a* are positioned about axis of rotation 90*a* so as to be offset by 180 degrees. Cam guides 62*a*, 64*a* are positioned one behind the other in the axial direction.

Figure 7:
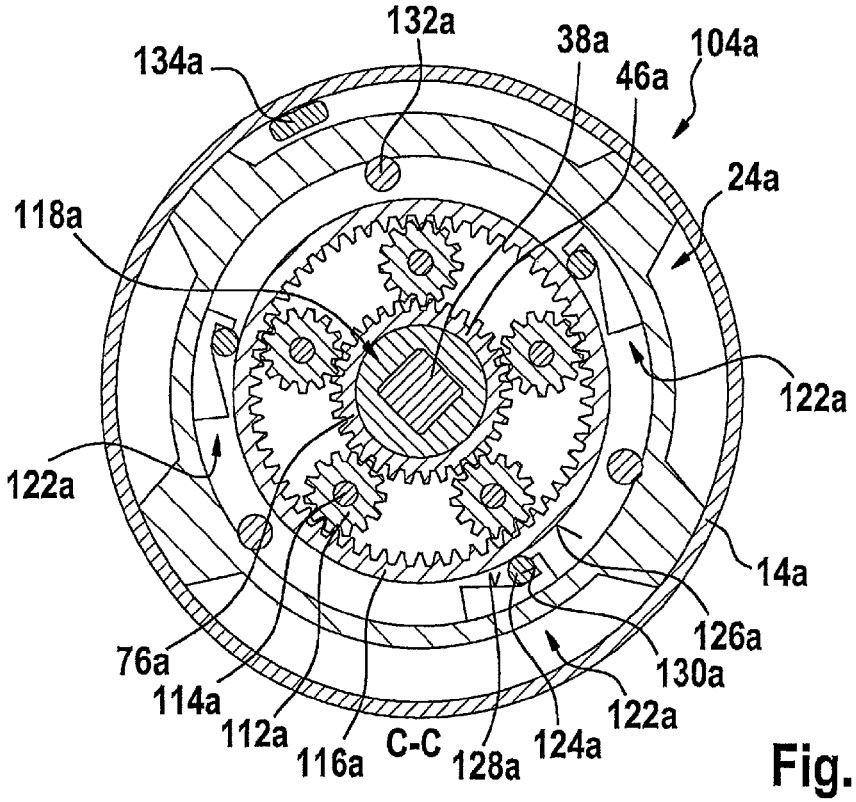
FIG. 7 shows a sectional plane C of a first planetary gear stage and of a first striker arresting device of the hand tool device from FIG. 1.

Planetary gearing 28*a* includes first planetary gear stage 104*a*, a second planetary gear stage 106*a*, a third planetary gear stage 108*a* and a fourth planetary gear stage 110*a*. FIG. 7 shows a sectional plane C of first planetary gear stage 104*a*. The planetary gear stages 104*a*, 106*a*, 108*a*, 110*a* illustrated in FIGS. 7, 12, 13 and 15 include gear wheels having a number of teeth considered suitable by one skilled in the art. The gear wheels of planetary gear stages 104*a*, 106*a*, 108*a*, 110*a* are in engagement with one another, which, in some instances, is not shown here in this manner. First planetary gear stage 104*a* increases a first rotational speed of second planetary gear stage 106*a* for driving striking mechanism 22*a*. Second planetary gear stage 106*a* drives tool spindle 38*a* at this first rotational speed. Gear teeth 76*a* of striking mechanism spindle 46*a* form a sun gear of first planetary gear stage 104*a*. Gear teeth 76*a* mesh with planet gears 112*a* of first planetary gear stage 104*a*, which are supported by a planet carrier 104*a* of first planetary gear stage. A ring gear 116*a* of first planetary gear stage 104*a* meshes with planet gears 112*a* of first planetary gear stage 104*a*.

In a percussion drill mode, first striker arresting device 24*a* fixes ring gear 116*a* of first planetary gear stage 104*a* in position relative to hand tool housing 14*a*. First striker arresting device 24*a* is configured to engage striker driving device 50*a* in the case of a first, clockwise drill rotation direction, and to automatically arrest striker driving device 50*a* in the case of a second, counterclockwise drill rotation direction. First striker arresting device 24*a* acts upon ring gear 116*a* of first planetary gear stage 104*a*. First striker arresting device 24*a* locks ring gear 116*a* of first planetary gear stage 104*a* in the first, clockwise drill rotation direction. In the case of the second, counterclockwise drill rotation direction, first striker arresting device 24*a* releases ring gear 116*a* of first planetary gear stage 104*a*, so that it may rotate. To that end, first striker arresting device 24*a* has three locking mechanisms 122*a*. Locking mechanisms 122*a* each include a blocking device 124*a*, a first wedging surface 126*a*, a second wedging surface 128*a* and free-running surfaces 130*a*. Blocking device 124*a* takes the form of a roller. First wedging surface 126*a* forms an external region of a surface of ring gear 116*a* of first planetary gear stage 104*a*. Second wedging surface 128*a* is positioned so as to be stationary relative to hand tool housing 14*a*. During operation in the first, clockwise drill rotation direction, blocking devices 124*a* become pinched between first wedging surfaces 126*a* and second wedging surface 128*a*. During operation in the second, counterclockwise drill rotation direction, free-running surfaces 130*a* guide blocking devices 124*a* and prevent locking.

In addition, FIG. 7 shows a connecting device 118*a*, which connects tool spindle 38*a* and a planet carrier 120*a* of second planetary gear stage 106*a* in a rotatably fixed manner. In this case, connecting device 118*a* connects tool spindle 38*a* and planet carrier 120*a* of second planetary gear stage 106*a* in an axially displaceable manner.

Figure 8:
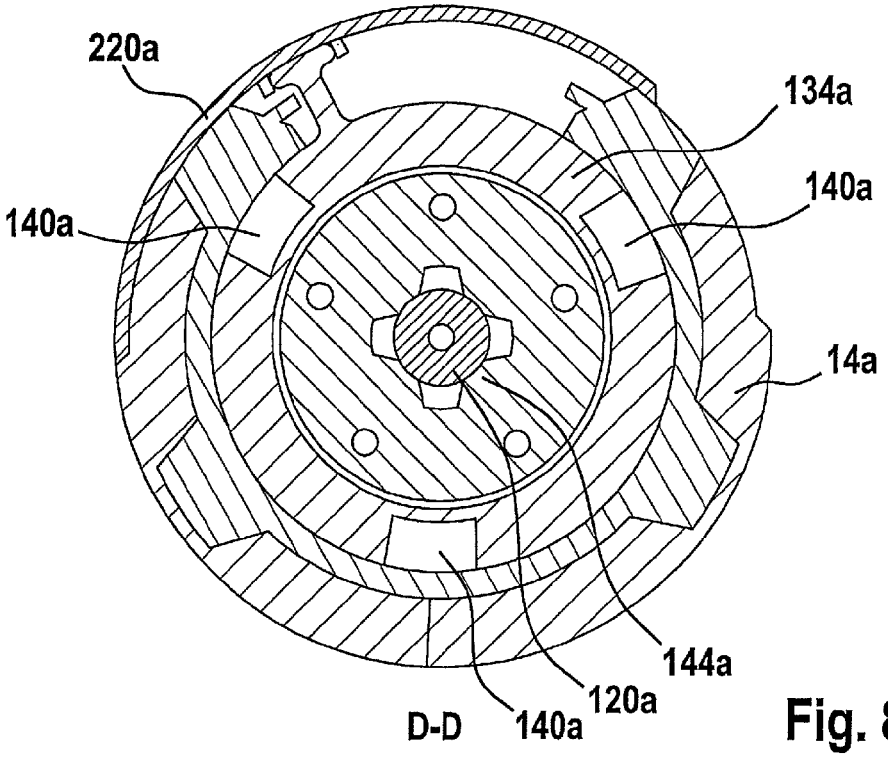
FIG. 8 shows a sectional plane D of a control element and of a second striker arresting device of the hand tool device from FIG. 1.
Figure 9:
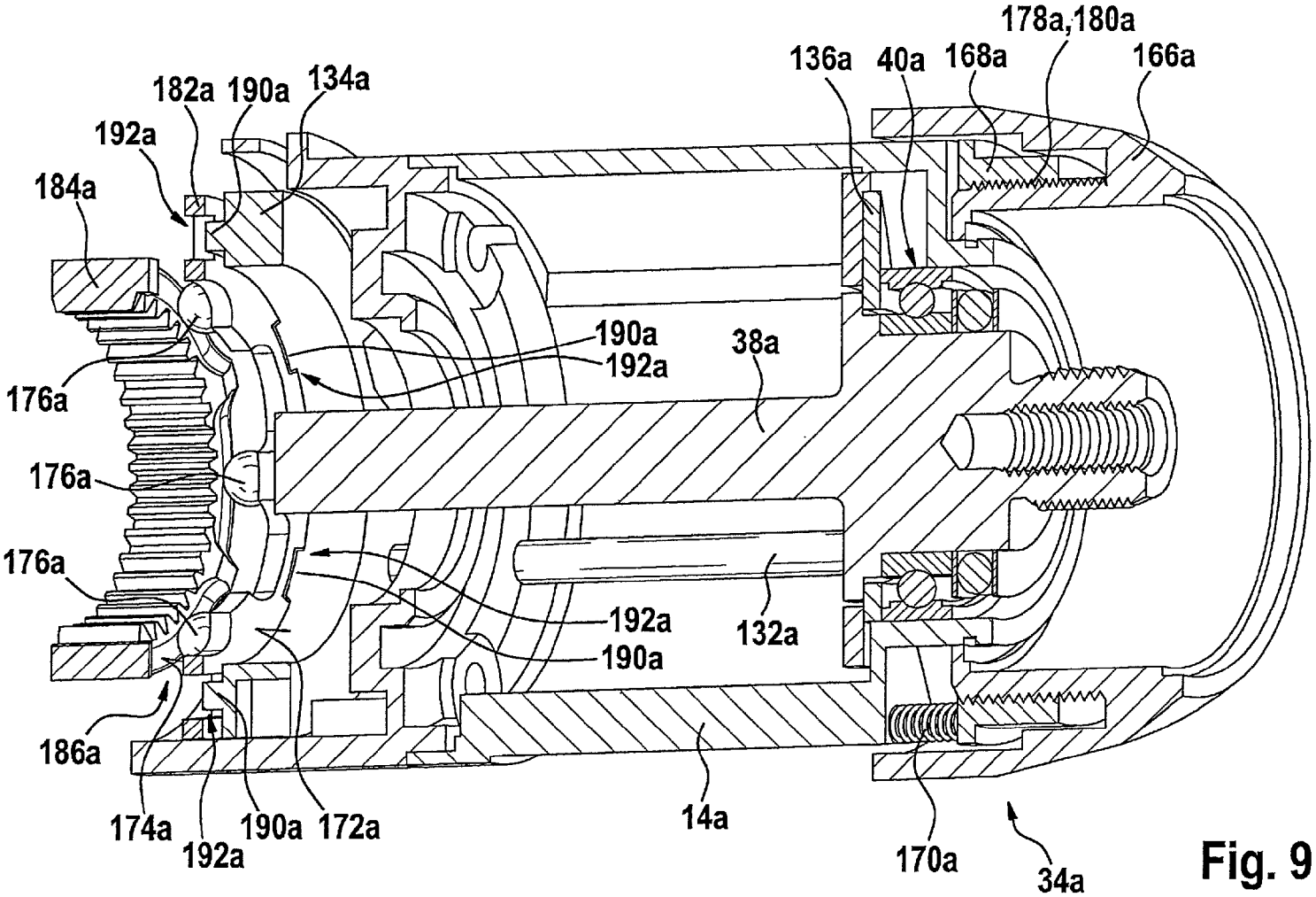
FIG. 9 shows a perspective sectional view of a part of the hand tool device from FIG. 1.

Furthermore, FIGS. 3, 4 and 7 show three first transmission devices 132*a* of second striker arresting device 26*a*. Transmission devices 132*a* take the form of rods. FIG. 8 shows a sectional plane D of a control element 134*a* of hand tool device 12*a*. FIG. 9 shows a perspective sectional view of second striker arresting device 26*a*. In a screwing mode illustrated in FIGS. 1, 8 and 9, as well as in a drilling mode, control element 134*a* supports tool support unit 20*a* in a direction opposite to striking direction 54*a*. A force applied to tool support unit 20*a* acts upon supporting surfaces 138*a* of control element 134*a* via bearing device 40*a*, a second transmission device 136*a* of second striker arresting device 26*a*, and first transmission device 132*a*. Control element 134*a* has three recesses 140*a*. In a percussion drill mode illustrated in FIG. 2, first transmission devices 132*a* may be pushed into recesses 140*a*, through which tool support unit 20*a* is axially moveable.

Second striker arresting device 26*a* has a striker arresting clutch 142*a*. Striker arresting clutch 142*a* is partially formed in one piece with planetary gearing 28*a*. Striker arresting clutch 142*a* is situated between first planetary gear stage 104*a* and second planetary gear stage 106*a*. Striker arresting clutch 142*a* has a first coupling element 144*a*, which is connected to a planet carrier 114*a* of first planetary gear stage 104*a* in a rotatably fixed manner. Striker arresting clutch 142*a* has a second coupling element 146*a*, which is connected to a planet carrier 120*a* of second planetary gear stage 106*a* in a rotatably fixed manner. In the illustrated screwing mode and drilling mode, striker arresting clutch 142*a* is open. In a percussion drill operation, tool spindle 38*a* transmits an axial coupling force to striker arresting clutch 142*a*, when the operator presses an insertion tool against a workpiece. The coupling force closes striker arresting clutch 142*a*. In FIG. 2, striker arresting clutch 142*a* is shown closed. When the operator removes the insertion tool from the workpiece, a striker engaging spring 148*a* of hand tool device 12*a* opens striker arresting clutch 142*a*.

Planet carrier 120*a* of second planetary gear stage 106*a* is formed in two parts. A first part 150*a* of planet carrier 120*a* of second planetary gear stage 106*a* is connected to tool spindle 38*a* in a rotatably fixed manner. First part 150*a* of planet carrier 120*a* is connected to tool spindle 38*a* in an axially displaceable manner, which means that even in the event of a stroke, planet carrier 120*a* remains rotationally coupled to tool spindle 38*a*. Thus, first part 150*a* is permanently connected to tool spindle 38*a*. First part 150*a* of planet carrier 120*a* is supported against striker engagement spring 148*a* in an axially displaceable manner. A second part 152*a* of planet carrier 120*a* of second planetary gear stage 106*a* is connected to first part 150*a* of planet carrier 120*a* in a rotatably fixed manner. First part 150*a* and second part 152*a* of planet carrier 120*a* are connected so as to be axially displaceable relative to one another. First part 150*a* and second part 152*a* of planet carrier 120*a* are permanently connected in a rotatably fixed manner.

Figure 10:
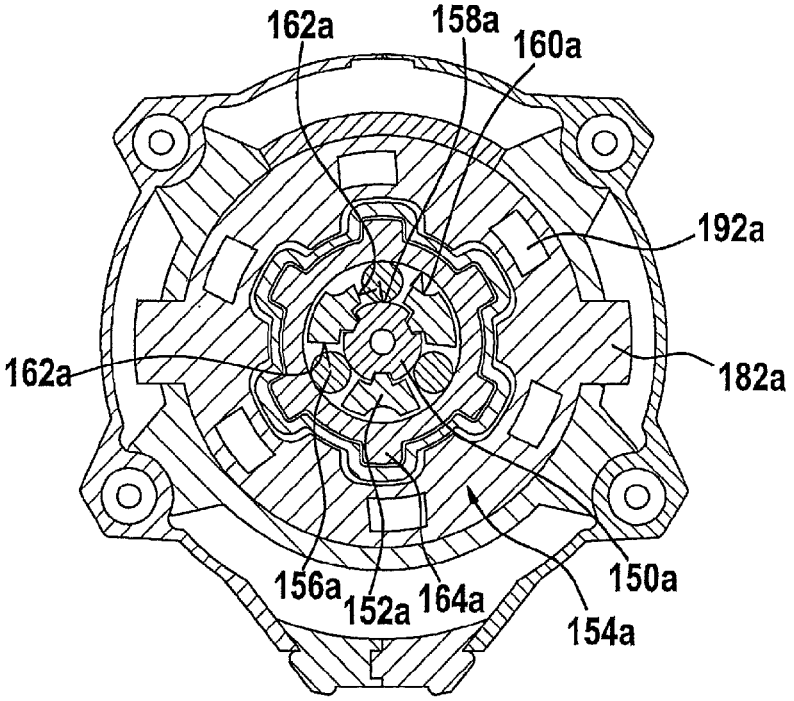
FIG. 10 shows a sectional plane E of a spindle locking device of the hand tool device from FIG. 1.

FIG. 10 shows a sectional plane of a spindle locking device 154*a* of hand tool device 12*a*. Spindle locking device 154*a* is provided for connecting tool spindle 38*a* to hand tool housing 14*a* in a rotatably fixed manner, when a tool torque is applied to tool chuck 36*a*, for example, when an insertion tool is clamped in tool chuck 36*a*. Spindle locking device 154*a* is partially formed in one piece with planet carrier 120*a* of second planetary gear stage 106*a*. Spindle locking device 154*a* has blocking devices 156*a*, first wedging surfaces 158*a*, a second wedging surface 160*a* and free-running surfaces 162*a*. Blocking devices 156*a* are cylindrical. First wedging surfaces 158*a* take the form of regions of a surface of first part 150*a* of planet carrier 120*a* of second planetary gear stage 106*a*. First wedging surfaces 158*a* are formed evenly. Second wedging surface 160*a* is formed as an inner side of a clamping ring 164*a* of spindle locking device 154*a*. Clamping ring 164*a* is connected to hand tool housing 14*a* in a rotatably fixed manner. Free-running surfaces 162*a* are formed as regions of a surface of second part 152*a* of planet carrier 120*a* of second planetary gear stage 106*a*. When a tool torque is applied to tool chuck 36*a*, blocking devices 156*a* become wedged between first wedging surfaces 158*a* and second wedging surface 160*a*. When drive unit 30*a* operates, free-running surfaces 162*a* lead blocking devices 156*a* on a circular path and prevent jamming. First part 150*a* and second part 152*a* of planet carrier 120*a* are engaged with one another with play.

Figure 11:
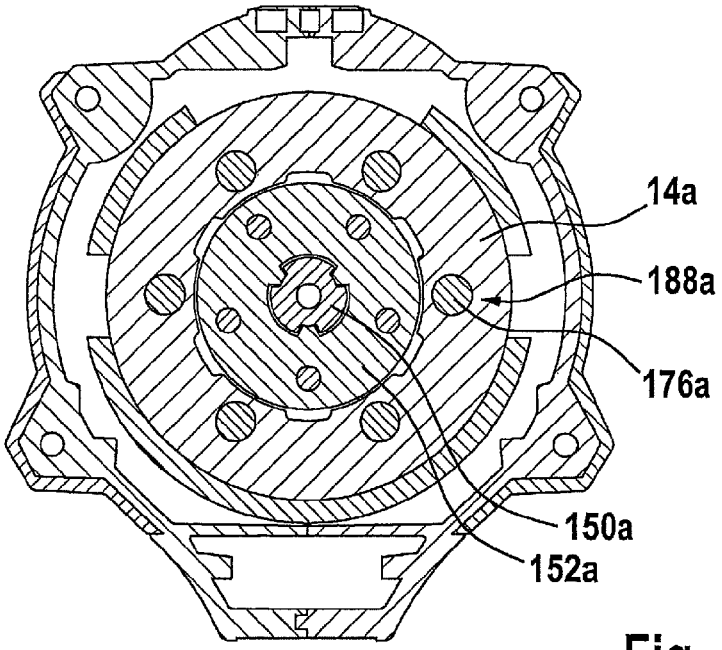
FIG. 11 shows a sectional plane F of blocking devices of the spindle locking device of the hand tool device from FIG. 1.

FIGS. 1, 2, 9 and 10 show torque limiting unit 34*a*. Torque limiting unit 34*a* is designed to limit a maximum tool torque outputted by tool chuck 36*a* in a screwing mode. Torque limiting unit 34*a* includes an operating element 166*a*, an adjusting element 168*a*, limiting springs 170*a*, transmission devices not shown in further detail, first stop faces 172*a*, a second stop face 174*a* and limiting devices 176*a*. Operating element 166*a* is annular. It follows tool chuck 36*a* in the direction of planetary gearing 28*a*. Operating element 166*a* includes a setting thread 178*a*, which is coupled to a setting thread 180*a* of adjusting element 168*a*. Adjusting element 168*a* is supported in a rotatably fixed and axially displaceable manner. When operating element 166*a* is rotated, adjusting element 168*a* is displaced in the axial direction. On one side, limiting springs 170*a* are supported at adjusting element 168*a*. On another side, limiting springs 170*a* are supported at a limit stop device 182*a* of torque limiting unit 34*a*, via the transmission devices. A surface of limit stop device 182*a* includes first stop faces 172*a*. In the screwing mode, limit stop device 182*a* is movably supported in opposition to limiting springs 170*a* in the axial direction. Second stop face 174*a* takes the form of a region of a surface of a ring gear 184*a* of second planetary gear stage 106*a*. Second stop face 174*a* has trough-shaped depressions 186*a*. Limiting devices 176*a* are formed in the shape of spheres. Limiting devices 176*a* are supported in tubular channels 188*a* so as to be displaceable in striking direction 54*a*. FIG. 11 shows a sectional plane F of torque limiting unit 34*a*. In a screwing operation, limiting devices 176*a* are situated in trough-shaped depressions 186*a*. In this instance, limiting devices 176*a* secure ring gear 184*a* of second planetary gear stage 106*a* in a rotatably fixed manner. In response to the set, maximum tool torque being reached, limiting devices 176*a* push limit stop device 182*a* away, against limiting springs 170*a*. Then, limiting devices 176*a* each spring into the nearest of the trough-shaped depressions 186*a*. In the process, ring gear 184*a* of second planetary gear stage 106*a* rotates, thereby interrupting the screwing operation.

Control element 134*a* of hand tool device 12*a* has support devices 190*a*, which prevent an axial movement of limit stop device 182*a* in at least a drilling mode. To that end, support devices 190*a* brace limit stop device 182*a* in the axial direction. In the case of a screwing mode illustrated, in particular, in FIG. 9, limit stop device 182*a* has screw openings 192*a*, into which limit stop devices 182*a* enter when the maximum tool torque is reached. In the case of a screwing setting of control element 134*a*, the support devices 190*a* are correspondingly positioned. In a percussion drill mode, support devices 190*a* also prevent an axial movement of limit stop device 182*a* and, therefore, a response of torque limiting unit 34*a*. As an alternative, in a percussion drill mode, limit stop devices could also be positioned in such a manner, that they are able to enter into screw openings. Consequently, a torque limiting unit would be active in percussion drill mode.

Figure 12:
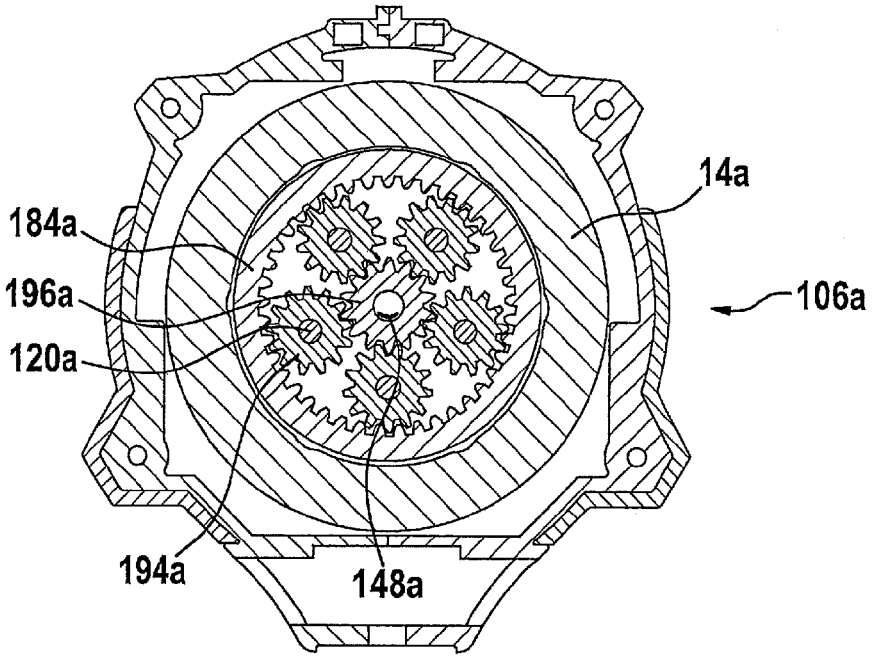
FIG. 12 shows a sectional plane G of a second planetary gear stage of the hand tool device from FIG. 1.

FIG. 12 shows a sectional plane G of second planetary gear stage 106*a*. In at least a drilling mode, ring gear 184*a* of second planetary gear stage 106*a* is supported in hand tool housing 14*a* so as to be protected against complete rotation. Planet gears 194*a* of second planetary gear stage 106*a* mesh with ring gear 184*a* and a sun gear 196*a* of second planetary gear stage 106*a*.

Figure 13:
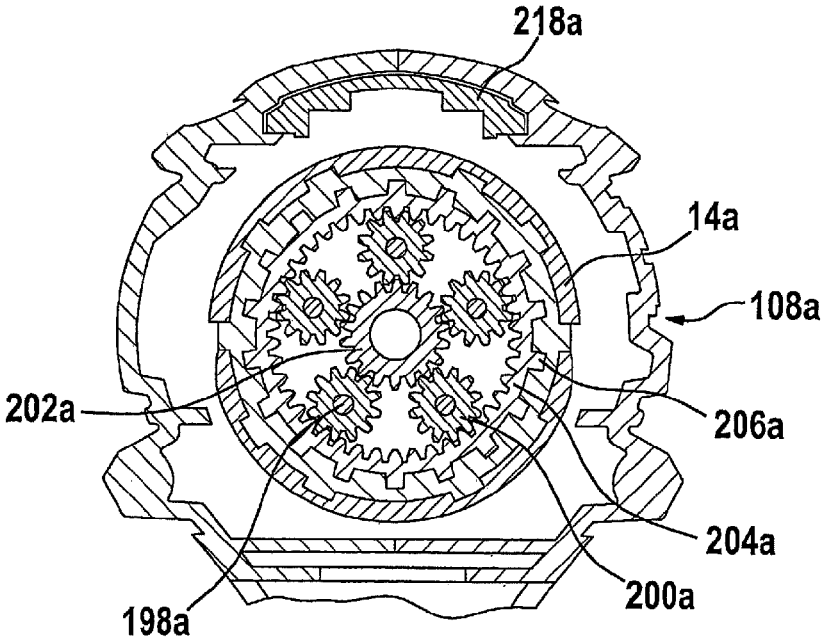
FIG. 13 shows a sectional plane H of a third planetary gear stage of the hand tool device from FIG. 1.

FIG. 13 shows a sectional plane H of third planetary gear stage 108*a*. Sun gear 196*a* of second planetary gear stage 106*a* is connected to a planet carrier 198*a* of third planetary gear stage 108*a* in a rotatably fixed manner. Planet gears 200*a* of third planetary gear stage 108*a* mesh with a sun gear 202*a* and a ring gear 204*a* of third planetary gear stage 108*a*. Ring gear 204*a* of third planetary gear stage 108*a* has toothing 206*a*, which, in a first gear ratio, connects ring gear 204*a* of third planetary gear stage 108*a* to hand tool housing 14*a* in a rotatably fixed manner.

Figure 14:
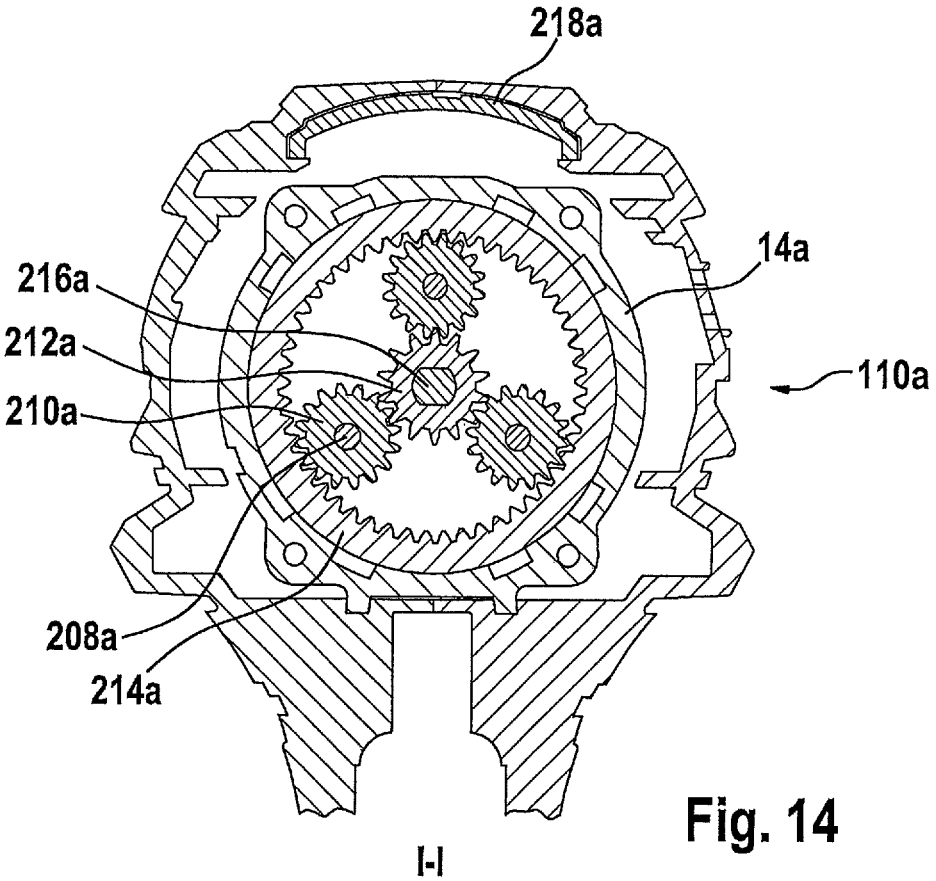
FIG. 14 shows a sectional plane I of a fourth planetary gear stage of the hand tool device from FIG. 1.

FIG. 14 shows a sectional plane I of third planetary gear stage 108*a*. Sun gear 202*a* of third planetary gear stage 108*a* is connected to a planet carrier 208*a* of fourth planetary gear stage 110*a* in a rotatably fixed manner. Planet gears 210*a* of fourth planetary gear stage 110*a* mesh with a sun gear 212*a* and a ring gear 214*a* of fourth planetary gear stage 110*a*. Ring gear 214*a* is connected to hand tool housing 14*a* in a rotatably fixed manner. Sun gear 212*a* of fourth planetary gear stage 110*a* is connected to a rotor 216*a* of drive unit 30*a* in a rotatably fixed manner.

As shown in FIG. 2, ring gear 204*a* of third planetary gear stage 108*a* is supported so as to be displaceable in the axial direction. In the first gear ratio, ring gear 204*a* of third planetary gear stage 108*a* is connected to hand tool housing 14*a* in a rotatably fixed manner. In the second gear ratio, ring gear 204*a* of third planetary gear stage 108*a* is connected to planet carrier 208*a* of fourth planetary gear stage 110*a* in a rotatably fixed manner, and is supported so as to be rotatable relative to hand tool housing 14*a*. This produces a reduction ratio of the first gear ratio between rotor 216*a* of drive unit 30*a* and planet carrier 198*a* of third planetary gear stage 108*a*, which is greater than a reduction ratio of the second gear ratio.

Operating device 32*a* has a first operating element 218*a* and a second operating element 220*a*. First operating element 218*a* is situated on a side of hand tool housing 14*a* facing away from handle 18*a*. It is supported so as to be movable parallelly to the axial direction of planetary gearing 28*a*. First operating element 218*a* is connected to ring gear 204*a* of third planetary gear stage 108*a* in the axial direction by an adjusting device 222*a* of operating device 32*a*. Ring gear 204*a* of third planetary gear stage 108*a* has a keyway 224, with which adjusting device 222*a* engages. Consequently, ring gear 204*a* of third planetary gear stage 108*a* is connected to adjusting device 222*a* in the axial direction, so as to be axially rotatable relative to adjusting device 222*a*. Adjusting device 222*a* is designed to be elastic, which means that the gear ratio may be adjusted independently of a rotational position of ring gear 204*a* of third planetary gear stage 108*a*. When first operating element 218*a* is pushed in the direction of tool chuck 36*a*, the first gear ratio is set. When second operating element 220*a* is pushed away from tool chuck 36*a*, the second gear ratio is set.

Second operating element 220*a* is situated on a side of hand tool housing 14*a* facing away from handle 18*a*. Second operating element 220*a* is positioned so as to be displaceable about an axis, which is oriented parallel to the axial direction of planetary gearing 28*a*. Second operating element 220*a* is connected to control element 134*a* of hand tool device 12*a* in a rotatably fixed manner. The screwing mode, the drilling mode and the percussion drill mode may be set, using second operating element 220*a*. When second operating element 220*a* is pushed to the left, as viewed in striking direction 54*a*, the percussion drill mode is set. When second operating element 220*a* is pushed to the right, as viewed in striking direction 54*a*, the screwing mode is set. When second operating element 220*a* is positioned centrally, as viewed in striking direction 54*a*, the drilling mode is set.

Figure 15:
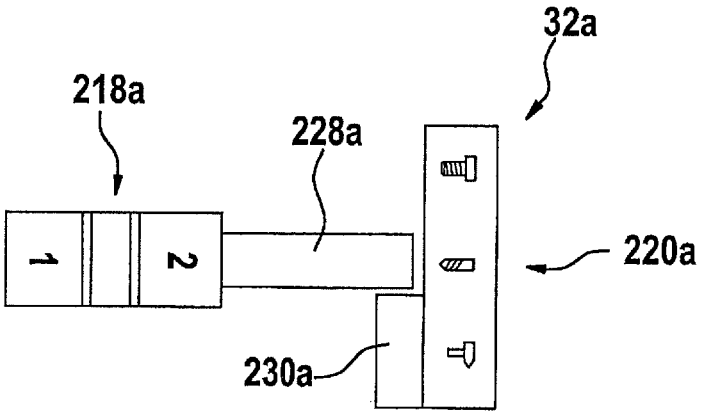
FIG. 15 shows a schematic representation of an operating device and a safety device of the hand tool device from FIG. 1.

FIG. 15 schematically illustrates a safety device 226*a* of hand tool device 12*a*, which prevents operation in the percussion drill mode at the first gear ratio. In FIG. 15, the first gear ratio and the drilling mode are set. Safety device 226*a* is partially formed in one piece with operating device 32*a*. A first blocking device 228*a* of safety device 226*a* is formed on first operating element 218*a*. A second blocking device 230*a* of safety device 226*a* is formed on second operating element 220*a*. Blocking devices 228*a* are each tongue-shaped. First blocking device 228*a* extends in the direction of second operating element 220*a*. Second blocking device 230*a* extends in the direction of first operating element 218*a*. Safety device 226*a* prevents a switchover into the percussion drill mode, when the first gear ratio is set. Safety device 226*a* prevents a switchover into the first gear ratio, when the percussion drill mode is set.

Drive unit 30*a* takes the form of an electric motor. Drive unit 30*a* has a maximum torque, which produces a maximum tool torque of greater than 15 Nm at the first gear ratio, and less than 15 Nm at the second gear ratio. The maximum tool torque at the first gear ratio is 30 Nm. The maximum tool torque at the second gear ratio is 10 Nm. In this context, the tool torque is to be determined according to the DIN EN 60745 standard.

In a percussion drill mode, striker engagement spring 148*a* of hand tool device 12*a* opens striker arresting clutch 142*a* when the operator removes the insertion tool from the workpiece. Striker engagement spring 148*a* is positioned coaxially to planetary gear stages 104*a*, 106*a*, 108*a*, 110*a* of planetary gearing 28*a*. Second planetary gear stage 106*a* and third planetary gear stage 108*a* each surround striker engagement spring 148*a* on at least one plane, which is oriented perpendicularly to the axial direction of planetary gearing 28*a*. Second planetary gear stage 106*a* and third planetary gear stage 108*a* are each positioned functionally between at least two further planetary gear stages 104*a*, 106*a*, 108*a*, 110*a* of planetary gearing 28*a*. Planet carrier 120*a* of second planetary gear stage 106*a* supports striker engagement spring 148*a* on a side facing away from tool chuck 36*a*.

Further exemplary embodiments of the present invention are shown in FIGS. 16 through 19. The following descriptions and the drawings are mainly limited to the differences between the exemplary embodiments. With regard to identically labeled components, in particular, with regard to components having the same reference characters, in general, reference may also be made to the drawings and/or the description of the other exemplary embodiments, in particular, of FIGS. 1 through 15. To distinguish between the exemplary embodiments, the letter "a" follows the reference numerals of the exemplary embodiment in FIGS. 1 through 15. In the exemplary embodiments of FIGS. 16 through 19, the letter "a" is replaced by the letters "b" through "e."

Figure 16:
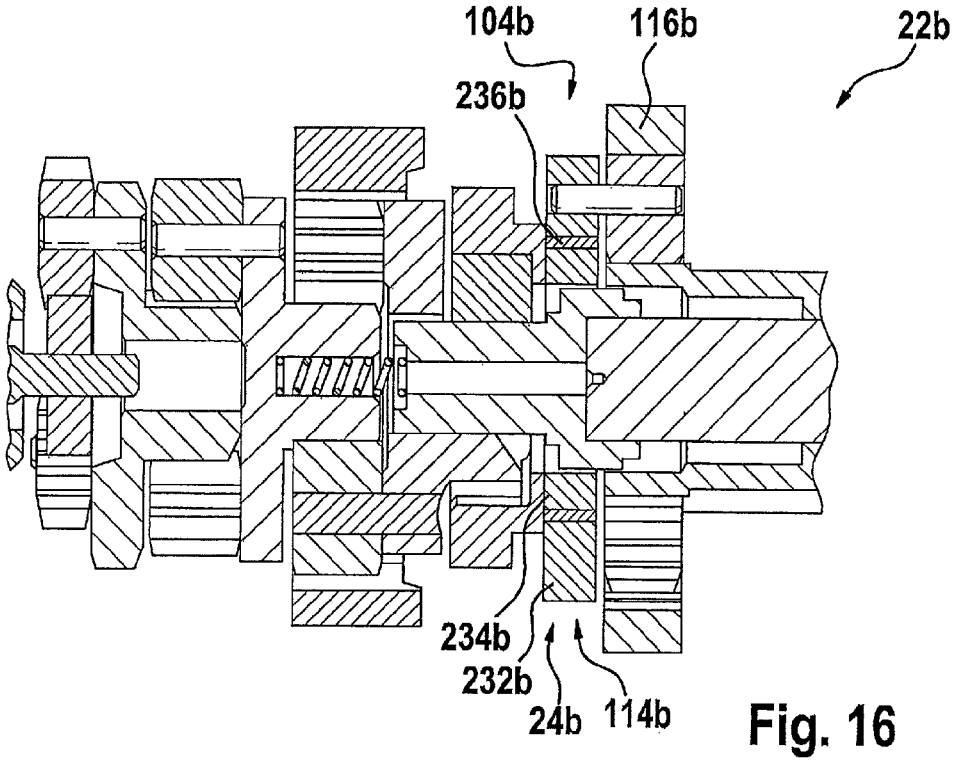
FIG. 16 shows an alternative exemplary embodiment of a first striker arresting device of a hand tool device according to the present invention.

A further, alternative exemplary embodiment of a first striker arresting device 24*b* is schematically illustrated in FIG. 16. A planet carrier 114*b* of a first planetary gear stage 104*b* is formed in two parts. A first part 232*b* of planet carrier 114*b* supports planet gears 112*b* of first planetary gear stage 104*b*. A second part 234*b* of planet carrier 114*b* is rotationally coupled to a second planetary gear stage 106*b*. A first striker arresting device 24*b* of a striking mechanism 22*b* has an overrunning clutch 236*b*, which is considered to be suitable by one skilled in the art, connects first part 232*b* and second part 234*b* of planet carrier 114*b* in a rotatably fixed manner in the case of a clockwise drill rotation direction, and separates them in the case of a counterclockwise drill rotation direction. A ring gear 116 of first planetary gear stage 104*b* is permanently connected to a hand tool housing in a rotatably fixed manner.

Figure 17:
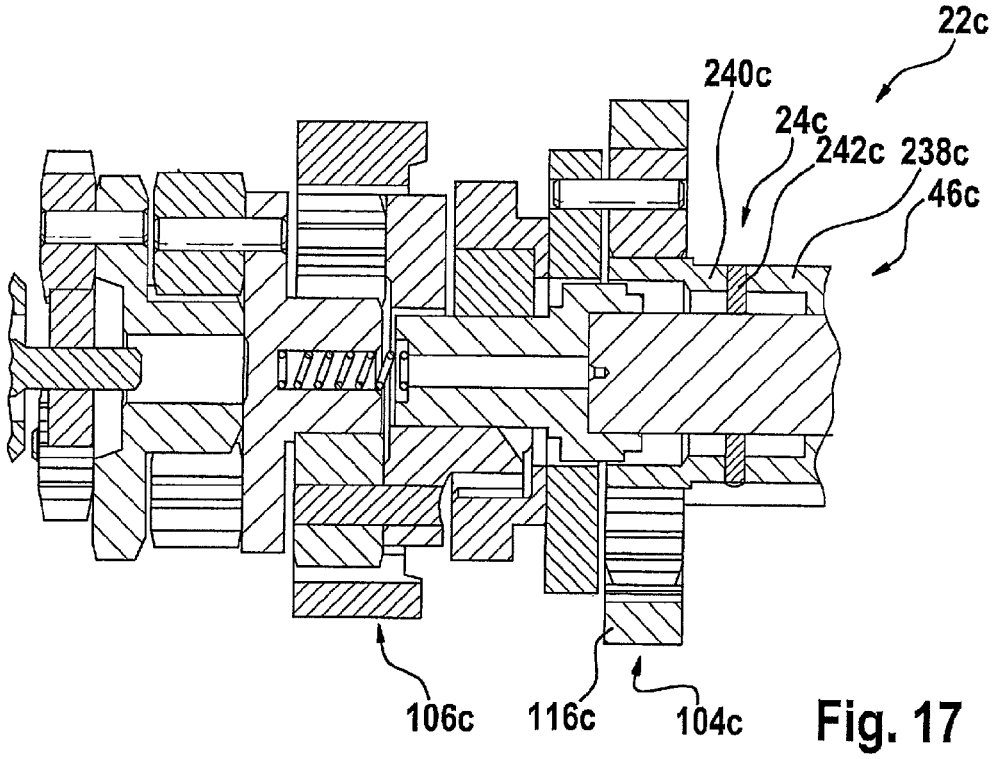
FIG. 17 shows a further exemplary embodiment of a first striker arresting device of a hand tool device according to the present invention.

A further exemplary embodiment of a first striker arresting device 24*c* is schematically illustrated in FIG. 17. A striking mechanism spindle 46*c* of a striking mechanism 22*c* is formed in two parts. A first part 238*c* of striking mechanism spindle 46*c* is connected to a striker driving device. A second part 240*c* of striking mechanism spindle 46*c* is connected to a second planetary gear stage 106*c*. First striker arresting device 24*c* has an overrunning clutch 242*c*, which is considered suitable by one skilled in the art, connects first part 238*b* and second part 240*c* of striking mechanism spindle 46*c* in a rotatably fixed manner in the case of a clockwise drill rotation direction, and separates them in the case of a counterclockwise drill rotation direction. A ring gear 116*c* of first planetary gear stage 104*c* is permanently connected to a hand tool housing in a rotatably fixed manner.

Figure 18:
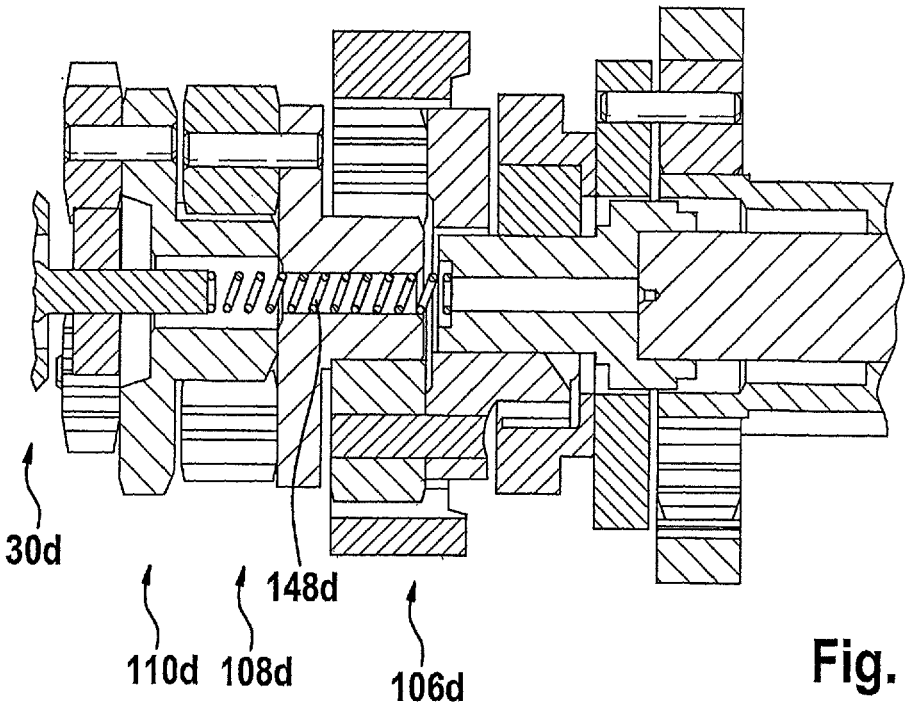
FIG. 18 shows an alternative exemplary embodiment of a striker engagement spring of a hand tool device according to the present invention.

A further exemplary embodiment of a striker engagement spring 148*d* is illustrated in FIG. 18. A second planetary gear stage 106*d* supports striker engagement spring 148*d* on a side facing a tool chuck. A drive unit 30*d* supports striker engagement spring 148*d* on a side facing away from a tool chuck. Second planetary gear stage 106*d*, a third planetary gear stage 108*d* and a fourth planetary gear stage 110*d* each surround striker engagement spring 148*d* on at least one plane, which is oriented perpendicularly to an axial direction of planetary gear stages 106*d*, 108*d*, 110*d*. Drive unit 30*d* is connected to a part of planetary gear stage 110*d* in a rotatably fixed manner.

Figure 19:
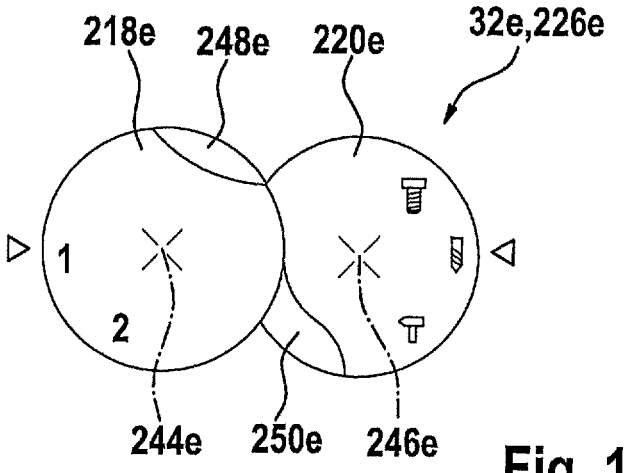
FIG. 19 shows an alternative exemplary embodiment of an operating device and of a safety device of a hand tool device according to the present invention.

FIG. 19 shows an alternative exemplary embodiment of operating device 32*e* and of a safety device 226*e*. Operating device 32*e* has a first operating element 218*e* and a second operating element 220*e*. Operating elements 218*e*, 220*e* are pivoted about axes of rotation 244*e*, 246*e*. Operating elements 218*e*, 220*e* are basically disk-shaped. First operating element 218*e* is connected to planetary gearing in a manner not shown in further detail, using a mechanism considered suitable by one skilled in the art. A first gear ratio and a second gear ratio may be set with the aid of first operating element 218*e*. Second operating element 220*e* is connected to a control element in a manner not shown in further detail, using a mechanism considered suitable by one skilled in the art. A screwing mode, a drilling mode and a percussion drill mode may be set with the aid of second operating element 220*e*. In addition, a chipping mode could be set.

Safety device 226*e* has a free-running region 248*e* delimited by first operating element 218*e*. Safety device 226*e* has a free-running region 250*e* delimited by second operating element 220*e*. Free-running region 248*e* of first operating element 218*e* allows the screwing mode, the drilling mode and the percussion drill mode to be set, when a second gear ratio is set. Free-running region 250*e* of second operating element 220*e* allows the screwing mode and the drilling mode to be set, when a first gear ratio is set. In the percussion drill mode, safety device 226*e* prevents the first gear ratio from being set. When the first gear ratio is set, safety device 226*e* prevents the percussion drill mode from being set.

What is claimed is:

1. A hand tool device, comprising:

a tool chuck having an axis of rotation;

a striking mechanism which has a striker, a striker driving device, and a striker arresting device; and a planetary gear stage which operates the striker driving device in at least one operating state, the planetary gear stage including at least one planet gear which is connected to a planet carrier and coupled to a ring gear in a radially outward direction and coupled to a sun gear in a radially inward direction;

wherein in the case of a clockwise drill rotation direction, the striker driving device is configured to propel the striker in at least a striking direction, the striking direction running parallel to the axis of rotation of the tool chuck and pointing from the striker towards the tool chuck, and the clockwise drill rotation direction being a clockwise rotational direction of the tool chuck when viewed in the striking direction;

the striker arresting device is configured to prevent the striker driving device from being operated in the case of a counterclockwise drill rotation direction, the counterclockwise drill rotation direction being a counterclockwise rotational direction of the tool chuck when viewed in the striking direction; and the striker arresting device is configured to automatically prevent the striker driving device from being operated in the case of the counterclockwise drill rotation direction, wherein the striker arresting device acts upon a ring gear of the planetary gear stage, wherein the striker arresting device has at least one locking mechanism, wherein the locking mechanism includes a blocking device, a first wedging surface, a second wedging surface, and a free-running surface, wherein the first wedging surface forms an outer surface of the ring gear and the second wedging surface is disposed fixedly relative to a housing.

2. The hand tool device as recited in claim 1, wherein the striker arresting device has three locking mechanisms, each of the locking mechanisms includes a blocking device, a first wedging surface, a second wedging surface, and a free-running surface, wherein the first wedging surface forms an outer surface of the ring gear and the second wedging surface is disposed fixedly relative to a housing.

3. The hand tool device as recited in claim 1, wherein the striker arresting device acts upon a ring gear of the planetary gear stage.

4. The hand tool device as recited in claim 1, wherein the striker arresting device acts upon a planet carrier of the planetary gear stage.

5. The hand tool device as recited in claim 1, wherein the striker arresting device acts upon a striking mechanism spindle of the striking mechanism.

6. The hand tool device as recited in claim 1, wherein the striker arresting device is configured to stop the striker driving device in the case of a counterclockwise drill rotation direction.

7. The hand tool device as recited in claim 1, wherein the striker driving device includes a cam guide which drives the striker in at least a percussion drill mode.

8. The hand tool device as recited in claim 7, wherein the cam guide includes a striker free-running region.

9. A hand-held tool comprising the hand tool device as defined in claim 1, and further comprising:

a hand tool housing; and a storage battery interface.

10. A hand tool device, comprising:

a tool chuck having an axis of rotation;

a striking mechanism which has a striker, a striker driving device, and a striker arresting device; and a planetary gear stage which operates the striker driving device in at least one operating state, the planetary gear stage including at least one planet gear which is connected to a planet carrier and coupled to a ring gear in a radially outward direction and coupled to a sun gear in a radially inward direction;

wherein in the case of a clockwise drill rotation direction, the striker driving device is configured to propel the striker in at least a striking direction, the striking direction running parallel to the axis of rotation of the tool chuck and pointing from the striker towards the tool chuck, and the clockwise drill rotation direction being a clockwise rotational direction of the tool chuck when viewed in the striking direction;

the striker arresting device is configured to prevent the striker driving device from being operated in the case of a counterclockwise drill rotation direction, the counterclockwise drill rotation direction being a counterclockwise rotational direction of the tool chuck when viewed in the striking direction; and the striker arresting device is configured to automatically prevent the striker driving device from being operated in the case of the counterclockwise drill rotation direction, wherein the striker arresting device acts upon a planet carrier of the planetary pear stage, wherein the planet carrier includes a first part and a second part, and the striker arresting device includes an overrunning clutch which is configured to connect the first part and the second part of the planet carrier in a rotatably fixed manner in the clockwise drill rotation direction and disconnect the first part and the second part from one another in the counterclockwise drill rotation direction.

11. The hand tool device as recited in claim 10, wherein the striker arresting device includes a blocking device which allows free-running in at least one operating state.

12. A hand tool device, comprising:

a tool chuck having an axis of rotation;

a striking mechanism which has a striker, a striker driving device, and a striker arresting device; and a planetary gear stage which operates the striker driving device in at least one operating state, the planetary gear stage including at least one planet gear which is connected to a planet carrier and coupled to a ring gear in a radially outward direction and coupled to a sun gear in a radially inward direction;

wherein in the case of a clockwise drill rotation direction, the striker driving device is configured to propel the striker in at least a striking direction, the striking direction running parallel to the axis of rotation of the tool chuck and pointing from the striker towards the tool chuck, and the clockwise drill rotation direction being a clockwise rotational direction of the tool chuck when viewed in the striking direction;

the striker arresting device is configured to prevent the striker driving device from being operated in the case of a counterclockwise drill rotation direction, the counterclockwise drill rotation direction being a counterclockwise rotational direction of the tool chuck when viewed in the striking direction; and the striker arresting device is configured to automatically prevent the striker driving device from being operated in the case of the counterclockwise drill rotation direction, wherein the striker arresting device acts upon a striking mechanism spindle of the striking mechanism, wherein the striking mechanism spindle includes a first part and a second part, and the striker arresting device includes an overrunning clutch which is configured to connect the first part and the second part of the striking mechanism spindle in a rotatably fixed manner in the clockwise drill rotation direction and disconnect the first part and the second part from one another in the counterclockwise drill rotation direction.

13. A hand tool device, comprising:

a tool chuck having an axis of rotation;

a striking mechanism which has a striker, a striker driving device, and a striker arresting device; and a planetary gear stage which operates the striker driving device in at least one operating state, the planetary gear stage including at least one planet gear which is connected to a planet carrier and coupled to a ring gear in a radially outward direction and coupled to a sun gear in a radially inward direction;

wherein in the case of a clockwise drill rotation direction, the striker driving device is configured to propel the striker in at least a striking direction, the striking direction running parallel to the axis of rotation of the tool chuck and pointing from the striker towards the tool chuck, and the clockwise drill rotation direction being a clockwise rotational direction of the tool chuck when viewed in the striking direction;

the striker arresting device is configured to prevent the striker driving device from being operated in the case of a counterclockwise drill rotation direction, the counterclockwise drill rotation direction being a counterclockwise rotational direction of the tool chuck when viewed in the striking direction; and the striker arresting device is configured to automatically prevent the striker driving device from being operated in the case of the counterclockwise drill rotation direction, wherein the striker arresting device has at least one locking mechanism, the locking mechanism including a blocking device in the form of a roller, a first wedging surface, a second wedging surface, and a free-running surface, wherein the first wedging surface forms an outer surface of the ring gear and the second wedging surface is disposed fixedly relative to a housing.

14. A hand tool device, comprising:

a striking mechanism which has a striker, a striker driving device, and a striker arresting device; and a planetary gear stage which operates the striker driving device in at least one operating state;

wherein in the case of a clockwise drill rotation direction, the striker driving device is configured to propel the striker in at least a striking direction;

the striker arresting device is configured to prevent the striker driving device from being operated in the case of a counterclockwise drill rotation direction, wherein the striker arresting device acts upon a ring gear of the planetary gear stage, wherein the striker arresting device has at least one locking mechanism, wherein the locking mechanism includes a blocking device in the form of a roller, a first wedging surface, a second wedging surface, and a free-running surface, wherein the first wedging surface forms an outer surface of the ring gear and the second wedging surface is disposed fixedly relative to a housing.

* * * * *